US010316781B2

(12) United States Patent
Genko

(10) Patent No.: US 10,316,781 B2
(45) Date of Patent: Jun. 11, 2019

(54) ENGINE SYSTEM AND CONTROL METHOD FOR ENGINE SYSTEM

(71) Applicant: TOYOTA JIDOSHA KABUSHIKI KAISHA, Toyota-shi, Aichi-ken (JP)

(72) Inventor: Takeshi Genko, Toyota (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 0 days.

(21) Appl. No.: 15/854,895

(22) Filed: Dec. 27, 2017

(65) Prior Publication Data

US 2018/0195456 A1 Jul. 12, 2018

(30) Foreign Application Priority Data

Jan. 11, 2017 (JP) ..... 2017-002532

(51) Int. Cl.

*F02D 41/24* (2006.01)
*F02D 41/06* (2006.01)
*F02D 41/22* (2006.01)
*F02D 41/30* (2006.01)

(52) U.S. Cl.

CPC ..... *F02D 41/2454* (2013.01); *F02D 41/065* (2013.01); *F02D 41/222* (2013.01); *F02D 41/2451* (2013.01); *F02D 41/3094* (2013.01); *F02D 2200/0402* (2013.01); *F02D 2200/0406* (2013.01); *F02D 2200/101* (2013.01); *F02D 2200/703* (2013.01)

(58) Field of Classification Search

CPC ..... F02D 2200/703; F02D 2200/0406; F02D 41/2441

USPC ..... 701/104, 108, 113

See application file for complete search history.

(56) References Cited

U.S. PATENT DOCUMENTS 4,590,563 A * 5/1986 Matsumura ..... F02D 41/182 123/406.49
8,527,183 B2 * 9/2013 Gallagher ..... F02D 35/024 123/456
2003/0029233 A1 * 2/2003 Ting ..... F02D 41/0072 73/114.76

(Continued)

FOREIGN PATENT DOCUMENTS

JP 2005061373 A * 3/2005
JP 2009-299599 12/2009

*Primary Examiner* — Hieu T Vo
*Assistant Examiner* — Arnold Castro
(74) *Attorney, Agent, or Firm* — Finnegan, Henderson, Farabow, Garrett & Dunner, LLP

(57) ABSTRACT

An engine system includes an engine, an atmospheric pressure sensor, an intake pressure sensor, and an electronic control unit. The electronic control unit is configured to execute atmospheric pressure learning for learning a relation between atmospheric pressure and an intake air amount of the engine based on the atmospheric pressure detected by the atmospheric pressure sensor, and execute fuel injection control of the engine using an initial value of an intake air amount model obtained based on the atmospheric pressure learning. The electronic control unit is configured to execute the fuel injection control of the engine using an initial value of the intake air amount model obtained based on the intake pressure detected by the intake pressure sensor, when rotational speed of the engine is less than a specified rotational speed at start of the fuel injection control of the engine.

4 Claims, 4 Drawing Sheets

(56) References Cited

U.S. PATENT DOCUMENTS

2014/0074377 A1* 3/2014 Petersen ..... F02D 41/32
701/104

* cited by examiner

ENGINE SYSTEM AND CONTROL METHOD FOR ENGINE SYSTEM

INCORPORATION BY REFERENCE

The disclosure of Japanese Patent Application No. 2017-002532 filed on Jan. 11, 2017 including the specification, drawings and abstract is incorporated herein by reference in its entirety.

BACKGROUND

1. Technical Field

The present disclosure relates to an engine system and a control method for the engine system.

2. Description of Related Art

Disclosed in Japanese Patent Application Publication No. 2009-299599 is an engine system that performs learning (atmospheric pressure learning) of a relation between a volumetric flow rate of air taken into an engine and an atmospheric pressure, the volumetric flow rate being detected by an airflow meter and the like, the atmospheric pressure being detected by an atmospheric pressure sensor. The engine system estimates an intake air amount by multiplying the volumetric flow rate of air taken into the engine by a coefficient obtained by the atmospheric pressure learning, and performs fuel injection control in accordance with the estimated intake air amount.

SUMMARY

However, in the aforementioned engine system, excessive fuel injection is performed at the start-up of the engine, which may cause emission deterioration. For example, assume the case where the engine is shut down, and then the engine is started up before the pressure of an intake system of the engine reaches the atmospheric pressure. In this case, if fuel injection control is performed in accordance with the intake air amount estimated based on atmospheric pressure learning, the estimated intake air amount becomes larger that an actual intake air amount, which leads to excessive fuel injection.

The present disclosure provides an engine system and a control method for the engine system to suppress emission deterioration.

A first aspect of the present disclosure is an engine system. The engine system includes an engine, an atmospheric pressure sensor, an intake pressure sensor, and an electronic control unit. The intake pressure sensor is configured to detect intake pressure of the engine. The electronic control unit is configured to execute atmospheric pressure learning for learning a relation between atmospheric pressure and an intake air amount of the engine based on the atmospheric pressure detected by the atmospheric pressure sensor. The electronic control unit is configured to execute fuel injection control of the engine using an initial value of an intake air amount model obtained based on the atmospheric pressure learning. The electronic control unit is configured to execute the fuel injection control of the engine using an initial value of the intake air amount model obtained based on the intake pressure detected by the intake pressure sensor, when rotational speed of the engine is less than a specified rotational speed at the start of the fuel injection control of the engine.

According to the configuration, the atmospheric pressure learning is executed for learning the relation between the atmospheric pressure and the intake air amount of the engine based on the atmospheric pressure detected by the atmospheric pressure sensor. In normal circumstances, the fuel injection control of the engine is executed using the initial value of the intake air amount model obtained based on the atmospheric pressure learning. When the rotational speed of the engine is less than a prescribed rotational speed at the start of the fuel injection control of the engine, the fuel injection control of the engine is executed using the initial value of the intake air amount model obtained based on the intake pressure detected by the intake pressure sensor. Accordingly, even when the engine is started up before the pressure of the intake system of the engine reaches the atmospheric pressure, it is possible to suppress the situation where an estimated intake air amount becomes larger than an actual intake air amount. As a result, excessive fuel injection can be suppressed, so that emission deterioration can be suppressed.

In the engine system, the electronic control unit may be configured to execute the fuel injection control using the initial value of the intake air amount model obtained based on the atmospheric pressure learning irrespective of the rotational speed of the engine, when prescribed tithe or more elapses after shutdown of the engine. When the engine has a relatively large rotational speed, driving of the engine is relatively stable. Accordingly, even when the fuel injection control is performed using the initial value of the intake air amount model obtained based on the atmospheric pressure learning, emission deterioration does not occur since a divergence between the estimated intake air amount and the actual intake air amount becomes small.

In the engine system, the electronic control unit may be configured to execute the fuel injection control using the initial value of the intake air amount model obtained based on the atmospheric pressure learning irrespective of the rotational speed of the engine, when abnormality occurs in the intake pressure sensor. The initial value of the intake air amount model based on the intake pressure sensor where abnormality occurs becomes too large or too small. Accordingly, using the initial value of the intake air amount model based on the atmospheric pressure learning can suppress emission deterioration.

A second aspect of the present disclosure is a control method for an engine system. The engine system includes an engine, an atmospheric pressure sensor, an intake pressure sensor, and an electronic control unit. The intake pressure sensor is configured to detect intake pressure of the engine. The control method includes: executing, by the electronic control unit, atmospheric pressure learning for learning a relation between atmospheric pressure and an intake air amount of the engine based on the atmospheric pressure detected by the atmospheric pressure sensor; executing, by the electronic control unit, fuel injection control of the engine using an initial value of an intake air amount model obtained based on the atmospheric pressure learning; and executing, by the electronic control unit, the fuel injection control of the engine using an initial value of the intake air amount model obtained based on the intake pressure detected by the intake pressure sensor, when rotational speed of the engine is less than a specified rotational speed at the start of the fuel injection control of the engine.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

Now, modes for carrying out the present disclosure will be described in detail based on embodiments.

Figure 1:
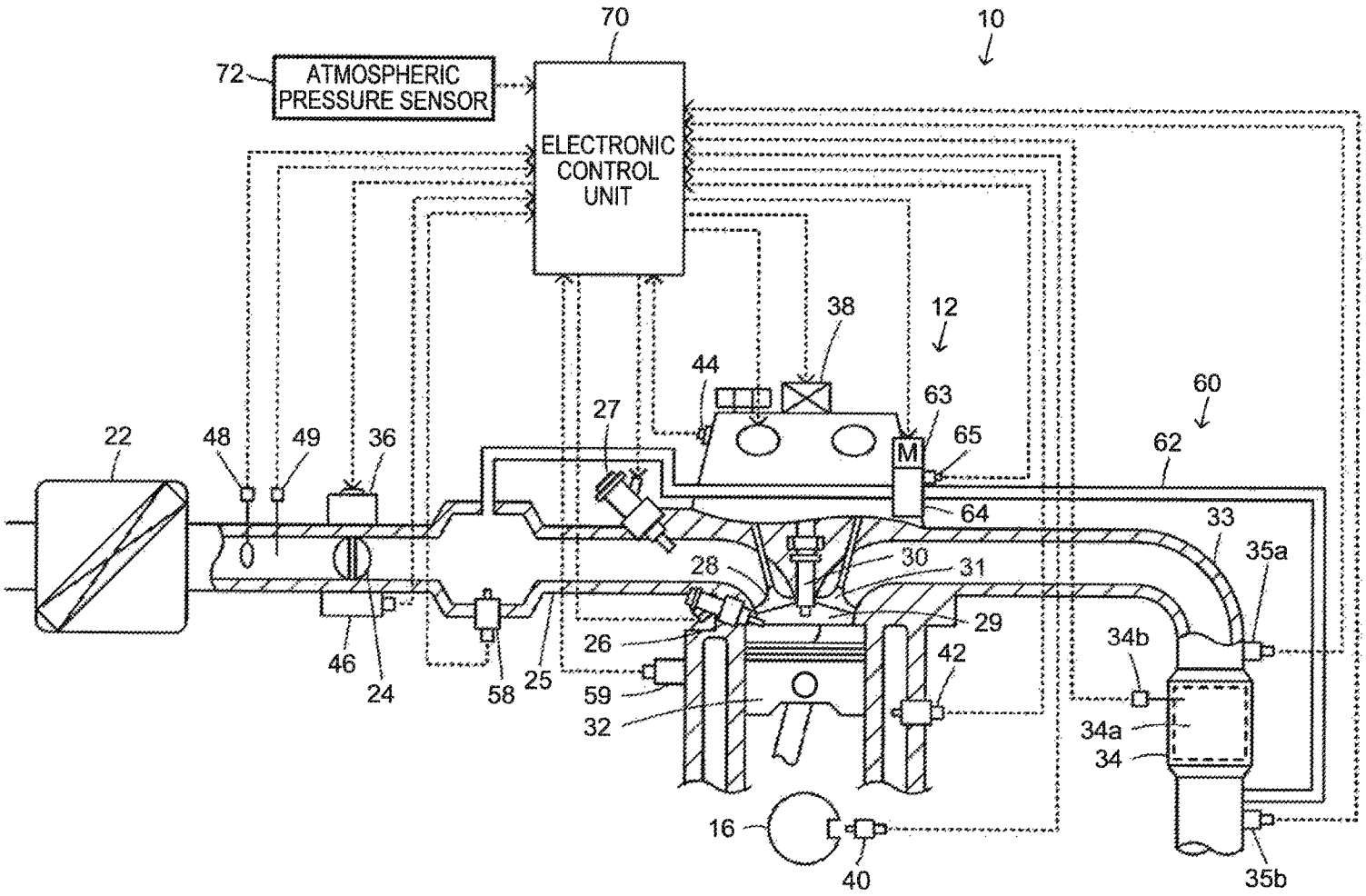
FIG. 1 is a block diagram illustrating an outlined configuration of an engine system as one embodiment of the present disclosure.

FIG. 1 is a block diagram illustrating an outlined configuration of an engine system 10 as one embodiment of the present disclosure. The engine system 10 of the embodiment is an engine system that can be mounted on general vehicles and various kinds of hybrid vehicles. As illustrated in the drawing, the engine system 10 includes an engine 12, and an electronic control unit 70 that performs operation control of the engine 12. The engine system 10 is mounted on vehicles such as a hybrid vehicle including the engine 12 and an unillustrated motor, and a vehicle that travels using only the mot power from the engine 12.

The engine 12 is configured as a 4-cylinder engine that outputs motive power in four strokes using fuel such as gasoline and diesel fuel, the four strokes including an intake stroke, a compression stroke, an expansion stroke, and an exhaust stroke. The engine 12 has a cylinder injector 26 as a cylinder injection valve that injects fuel into a cylinder, and a port injector 27 as a port injection valve that injects the fuel to an intake port. The engine 12 is operated in any one injection mode out of a port injection mode, a cylinder injection mode, and a common injection mode. The port injection mode is an injection mode for injecting fuel only from the port injector 27. The cylinder injection mode is an injection mode for injecting fuel only from the cylinder injector 26. The common injection mode is an injection mode for injecting fuel from the cylinder injector 26 and the port injector 27. In the port injection mode, air cleaned by an air cleaner 22 is taken into the intake pipe 25 while fuel is injected into the intake pipe 25 from the port injector 27 to produce an air-fuel mixture. The air-fuel mixture is taken into a combustion chamber 29 through an intake valve 23, and is combusted by electric spark generated by a spark plug 30. The energy of combustion pushes down a piston 32 to generate reciprocating movement, which is converted into rotational movement of a crankshaft 16. In the cylinder injection mode, air is taken into the combustion chamber 29, and fuel is injected into the combustion chamber 29 from the cylinder injector 26 during the intake stroke or at the start of compression stroke. The spark plug 30 provides electric spark to cause combustion, which produces rotational movement of the crankshaft 16. In the common injection driving mode, when air is taken into the combustion chamber 29, fuel is injected into the combustion chamber 29 from the port injector 27, while fuel is also injected into the combustion chamber 29 from the cylinder injector 26 in the intake stroke or the compression stroke. The spark plug 30 provides electric spark to cause combustion, which produces rotational movement of the crankshaft 16. Exhaust gas discharged from the combustion chamber 29 to an exhaust pipe 33 is discharged to the outside air through an exhaust gas control apparatus 34 having an exhaust gas purifying catalyst (three-way catalyst) 34*a* that removes harmful components including carbon monoxide (CO), hydrocarbon (HC), and nitrogen oxide (NOx). The exhaust gas in the exhaust pipe 33 is not only discharged to the outside air but also supplied to the intake pipe 25 through an exhaust gas recirculation system (hereinafter referred to as "EGR system") 60 that returns the exhaust gas to intake air. The EGR system 60 includes, an EGR pipe 62 and an EGR valve 64. The EGR pipe 62 provides communication between a portion of the exhaust pipe 33 downstream of the exhaust gas control apparatus 34 and a surge tank of the intake pipe 25. The EGR valve 64, which is provided in the EGR pipe 62, is driven with a stepping motor 63. The EGR system 60 regulates an opening degree of the EGR valve 64 and thereby regulates a return volume of the exhaust gas as unburnt gas to return the exhaust gas to the intake side. Thus, the engine 12 can suck a mixture of air, exhaust gas, and gasoline into the combustion chamber 29. Hereinafter, the exhaust gas returned from the exhaust pipe 33 to the intake pipe 25 is referred to as EGR gas, and the amount of EGR gas is referred to as an EGR amount.

Although not illustrated, the electronic control unit 70 is configured as a microprocessor having a CPU as a main component. The electronic control unit 70 includes, in addition to the CPU, a ROM that stores processing programs, a RAM that temporarily stores data, and input and output ports. The electronic control unit 70 receives signals from various sensors needed for operation control of the engine 12 through the input port. Examples of the signals input into the electronic control unit 70 may include a crank angle θcr from a crank position sensor 40 that detects the rotational position of the crankshaft 16, a coolant temperature Tw from a coolant temperature sensor 42 that detects the temperature of a coolant of the engine 12, and cam angles θci, θco from a earn position sensor 44 that detects the rotational position of an intake camshaft that opens and closes the intake valve 28 and the rotational position of an exhaust camshaft that opens and closes an exhaust valve 31. The examples of the signals may also include a throttle opening degree TH from a throttle valve position sensor 46 that detects the position of a throttle valve 24 provided in the intake pipe 25, an intake air amount Qa from an air flowmeter 48 attached to the intake pipe 25, an intake air temperature Ta from a temperature sensor 49 attached to the intake pipe 25, and an intake pressure Pin from an intake pressure sensor 58 that detects the pressure in the intake pipe 25. The examples of the signals may further include a catalyst temperature Tc from a temperature sensor 34*b* that detects the temperature of the exhaust gas purifying catalyst 34*a* of the exhaust gas control apparatus 34, an air-fuel ratio AF from an air-fuel ratio sensor 35*a* attached to the exhaust pipe 33, and an oxygen signal O2 from an oxygen sensor 35*b* attached to the exhaust pipe 33. The examples of the signals may also include a knock signal Ks from a knock sensor 59 attached to a cylinder block, the knock sensor 59 being configured to detect vibration generated when knocking occurs, an EGR valve opening degree EV from an EGR valve opening degree sensor 65 that detects the opening degree of the EGR valve 64, and an atmospheric pressure Pout from an atmospheric pressure sensor 72.

The electronic control unit 70 outputs various control signals for operation control of the engine 12 through the output port. Examples of the signals output from the electronic control unit 70 may include a driving control signal to a throttle motor 36 that regulates the position of the throttle valve 24, a driving control signal to the cylinder injector 26, and a driving control signal to the port injector 27. The examples of the signals may also include a driving control signal to an ignition coil 38 integrated with an igniter, and a control signal to a stepping motor 63 that regulates the opening degree of the EGR valve 64.

The electronic control unit 70 calculates the rotational speed of the crankshaft 16, i.e., a rotational speed Ne of the engine 12 (hereinafter, also referred as an engine rotational speed Ne), based on the crank angle θcr from the crank position sensor 40. The electronic control unit 70 also calculates a volumetric efficiency (a ratio of the volume of air actually taken in one cycle of the engine 12 to a stroke volume per cycle) KL as a load of the engine 12 based on the intake air amount Qa from the air flowmeter 48 and the rotational speed Ne of the engine 12.

In the thus-configured engine system 10 of the embodiment, the electronic control unit 70 performs control of the engine 12, such as intake air amount control, fuel injection control, ignition control, and EGR control, so that a required power Te* is output from the engine 12.

A description is now given of the operation of the thus-configured engine system 10 of the embodiment, and particularly of the operation when the intake air amount control is performed at the start-up of the engine 12. In the engine system 10 of the embodiment, when an execution condition of atmospheric pressure learning is satisfied, a relation between the atmospheric pressure Pout detected by the atmospheric pressure sensor 72 and the amount of intake air for fuel injection is learned. Examples of the execution condition may include a condition where no abnormality occurs in the atmospheric pressure sensor 72, the air flowmeter 48, or the air-fuel ratio sensor 35*a*, a condition where warm-up of the engine 12 is completed, and a condition where the engine 12 is in a steady operation state. Examples of the atmospheric pressure learning may include calculating and storing a conversion coefficient k in an intake air amount model that calculates an fuel injection amount by converting the intake air amount Qa, which is a volumetric flow rate of intake air, into a mass flow rate of the intake air based on the atmospheric pressure Pout, the intake air amount Qa, and the air-fuel ratio AF. The intake air amount model is used for calculating the fuel injection amount in the fuel injection control of the engine 12.

Figure 2:
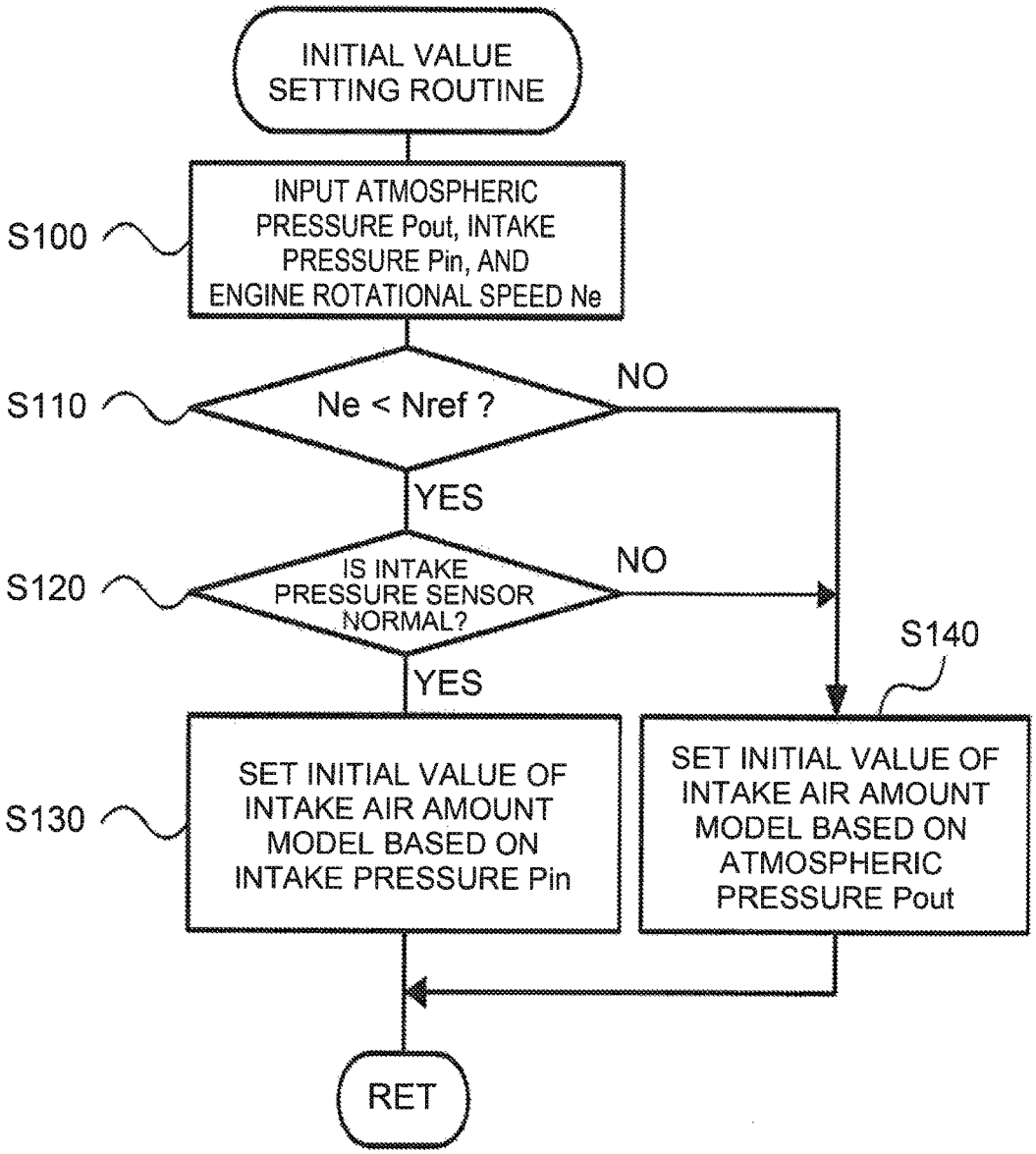
FIG. 2 is a flowchart illustrating one example of an initial value setting routine executed by an electronic control unit.

In the engine system 10 of the embodiment, an initial value of the intake air amount model at the start-up of the engine 12 is set by an initial value setting routine illustrated in FIG. 2. The routine is executed by the electronic control unit when the fuel injection control is started at the start-up of the engine 12.

When the initial value setting routine is executed, the electronic control unit 70 first executes processing of inputting parameters, such as the atmospheric pressure Pout from the atmospheric pressure sensor 72, the intake pressure Pin from the intake pressure sensor 58, and the rotational speed Ne of the engine 12 (step S100). As the rotational speed Ne of the engine 12, a value calculated based on the crank angle θcr from the crank position sensor 40 is input in the embodiment.

Next, it is determined whether or not the rotational speed Ne of the engine 12 is less than a threshold value Nref (step S110). When it is determined that the rotational speed Ne of the engine 12 is equal to or above the threshold value Nref, an air intake state of the engine 12 is determined to be relatively stable. Accordingly, the atmospheric pressure Pout from the atmospheric pressure sensor 72 is applied to the atmospheric pressure learning to perform normal intake air amount control. An initial value of the intake air amount model obtained as a result of the application is set (step S140), and the present routine is ended. When the initial value of the intake air amount model is set, subsequent intake air amount is calculated based on the initial value, and fuel injection control is performed.

When it is determined that the rotational speed Ne of the engine 12 is less than the threshold value Nref in step S110, it is determined whether or not the intake pressure sensor 58 is normal (step S120). Determination of whether or not the intake pressure sensor 58 is normal may be achieved by determining whether or not disconnection occurs in the signal lines, determining whether or not short-circuit occurs, determining whether or not the intake pressure sensor 58 is in a state where correct output is temporary disabled due to freezing based on the intake-air temperature Ta from the temperature sensor 49, or other determination. When it is determined that the intake pressure sensor 58 is normal, the initial value of the intake air amount model is set based on the intake pressure Pin (step S130), and the present routine is ended. When the initial value of the intake air amount model is set, subsequent intake air amount is calculated based on the initial value, and fuel injection control is performed. The initial value of the intake air amount model is set based on the intake pressure Pin from the intake pressure sensor 58, because the rotational speed Ne of the engine 12 is less than the threshold value Nref, and the air intake state of the engine 12 is thus relatively unstable. Accordingly, the intake air amount can be calculated more properly when the initial value of the intake air amount model is set based on the intake pressure Pin than when the initial value is set based on the atmospheric pressure Pout and atmospheric pressure learning. In the case where the engine 12 is stopped, and then the engine 12 is started up before the pressure of the intake pipe 25 returns to the atmospheric pressure in particular, the intake air amount becomes larger than an actual intake air amount when the initial value of the intake air amount model, which is obtained from the atmospheric pressure Pout from the atmospheric pressure sensor 72 and the atmospheric pressure learning, is used. This may lead to execution of excessive fuel injection. In the embodiment, the excessive fuel injection is suppressed by using the initial value of the intake air amount model based on the intake pressure Pin from the intake pressure sensor 58.

When it is determined that the intake pressure sensor 58 is not normal in step S120, it is determined that the initial value of the intake air amount model obtained based on the atmospheric pressure Pout from the atmospheric pressure sensor 72 and the atmospheric pressure learning is more proper than the initial value of the intake air amount model based on the intake pressure sensor 58 which is not normal, even though the fuel injection amount becomes slightly excessive. Accordingly, the initial value of the intake air amount model obtained based on the atmospheric pressure Pout and the atmospheric pressure learning is set (step S140), and the present routine is ended. When the initial value of the intake air amount model is set, subsequent intake air amount is calculated based on the initial value, and fuel injection control is performed.

Figure 3:
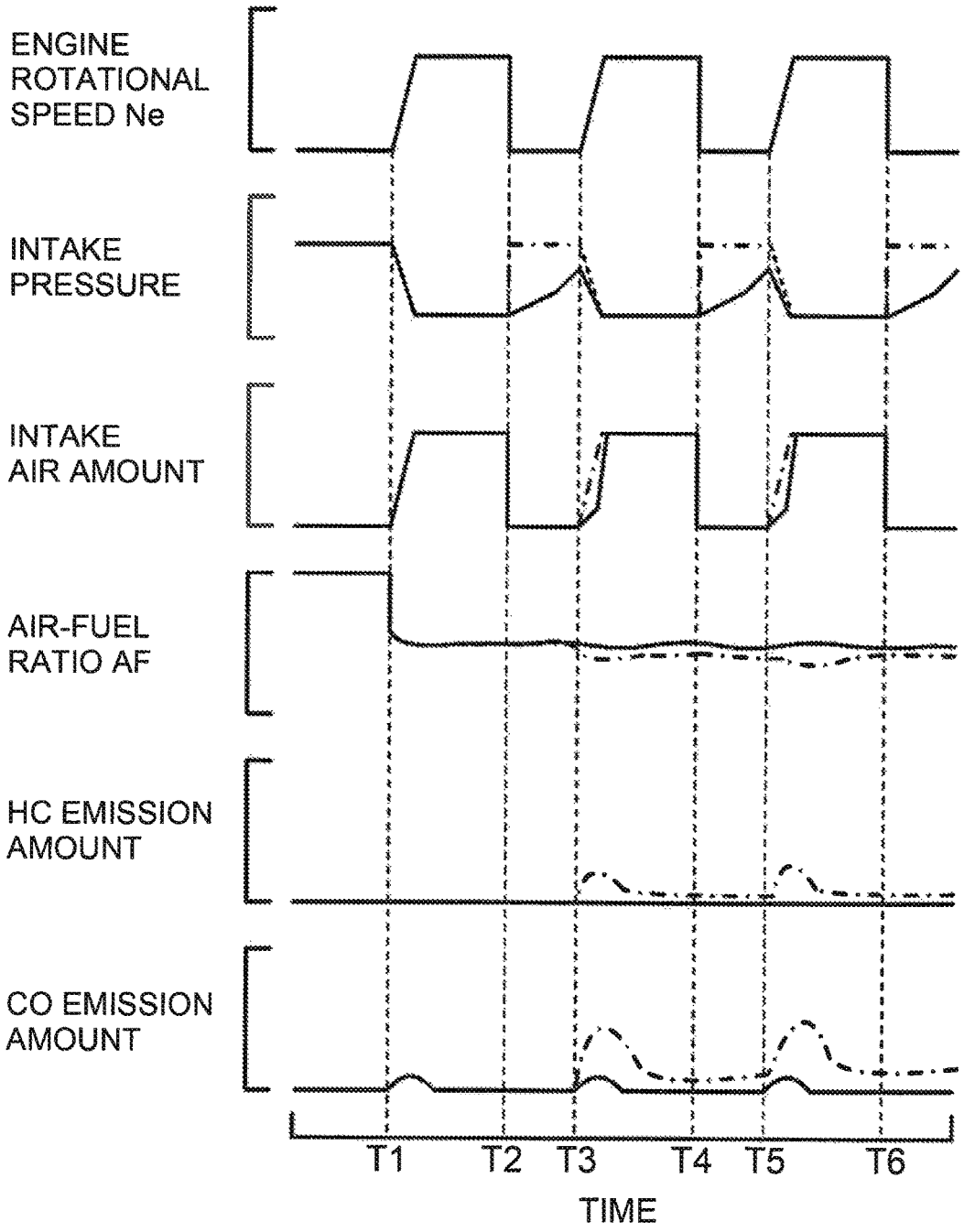
FIG. 3 is an explanatory view illustrating one example of temporal change in intake pressure, an intake air amount, an air-fuel ratio, an unburnt fuel emission amount (HC emission amount), and a carbon monoxide emission amount (CO emission amount) relative to engine operation.

FIG. 3 is an explanatory view illustrating one example of temporal change in an intake pressure, an intake air amount, an air-fuel ratio AF, an unburnt fuel emission amount (HC emission amount), and a carbon monoxide emission amount (CO emission amount) relative to operation of engine 12 in the case of using the initial value of the intake air amount model obtained based on the atmospheric pressure Pout from the atmospheric pressure sensor 72 and the atmospheric pressure learning (referred to as a comparative example below), and in the case of using the initial value of the intake air amount model based on the intake pressure Pin from the intake pressure sensor 58 (referred to as an embodiment below). In the drawing, solid lines represent the case of using the initial value of the intake air amount model based on the intake pressure Pin from the intake pressure sensor 58, and dashed dotted lines represent the case of using the initial value of the intake air amount model obtained based on the atmospheric pressure Pout from the atmospheric pressure sensor 72 and the atmospheric pressure learning. At time T1 when the engine 12 is first started up, the pressure of the intake pipe 25 is equal to the atmospheric pressure. Accordingly, both in the comparative example and the embodiment, the initial value of the intake air amount model is set to perform fuel injection control. As a consequence, the same air-fuel ratio AF is obtained. At time T2, the engine 12 is shut down. At time T3, the engine 12 is started up before the pressure of the intake pipe 25 returns to the atmospheric pressure. In the comparative example, since the initial value of the same intake air amount model is set based on the atmospheric pressure learning, the initial value of the intake air amount model same as that at time T1 is set. Accordingly, a larger intake air amount is calculated and excessive fuel injection is performed, so that the air-fuel ratio AF becomes small (rich). As a result, the unburnt fuel emission amount (HC emission amount) as well as the carbon monoxide emission amount (CO emission amount) are generated. In the embodiment, the initial value of the intake air amount model is set based on the intake pressure Pin from the intake pressure sensor 58. Accordingly, the intake air amount smaller than that of the comparative example is calculated, and excessive fuel injection is not performed. As a consequence, the air-fuel ratio AF shifts in the vicinity of a stoichiometric air-fuel ratio, so that almost no unburnt fuel emission amount (HC emission amount) is generated, and a small amount of carbon monoxide emission (CO emission) is generated. The engine 12 starts up at time T5 in a manner similar to that at time T3.

In the engine system 10 of the embodiment described in the foregoing, in the case where it is determined that the rotational speed Ne of the engine 12 is less than the threshold value Nref when the fuel injection control is performed at the start-up of the engine 12, the initial value of the intake air amount model based on the intake pressure Pin from the intake pressure sensor 58 is used to calculate subsequent intake air amount, and the fuel injection control is performed. Accordingly, excessive fuel injection can be suppressed as compared with the case where the initial value of the intake air amount model is set based on the atmospheric pressure Pout from the atmospheric pressure sensor 72 and the atmospheric pressure learning, when the rotational speed Ne of the engine 12 is less than the threshold value Nref. As a result, the unburnt fuel emission amount (the HC emission amount) and the carbon monoxide emission amount (the CO emission amount) can be decreased, so that emission deterioration can be suppressed. When it is determined that the intake pressure sensor 58 is not normal even though it is determined that the rotational speed Ne of the engine 12 is less than the threshold value Nref, the initial value of the intake air amount model based on the atmospheric pressure Pout from the atmospheric pressure sensor 72 and the atmospheric pressure learning is used. Accordingly, even though the fuel injection amount becomes slightly excessive, the intake air amount can be calculated more properly and fuel injection control can be performed more properly as compared with the case of using the initial value of the intake air amount model based on the intake pressure sensor 58 which is not normal.

Figure 4:
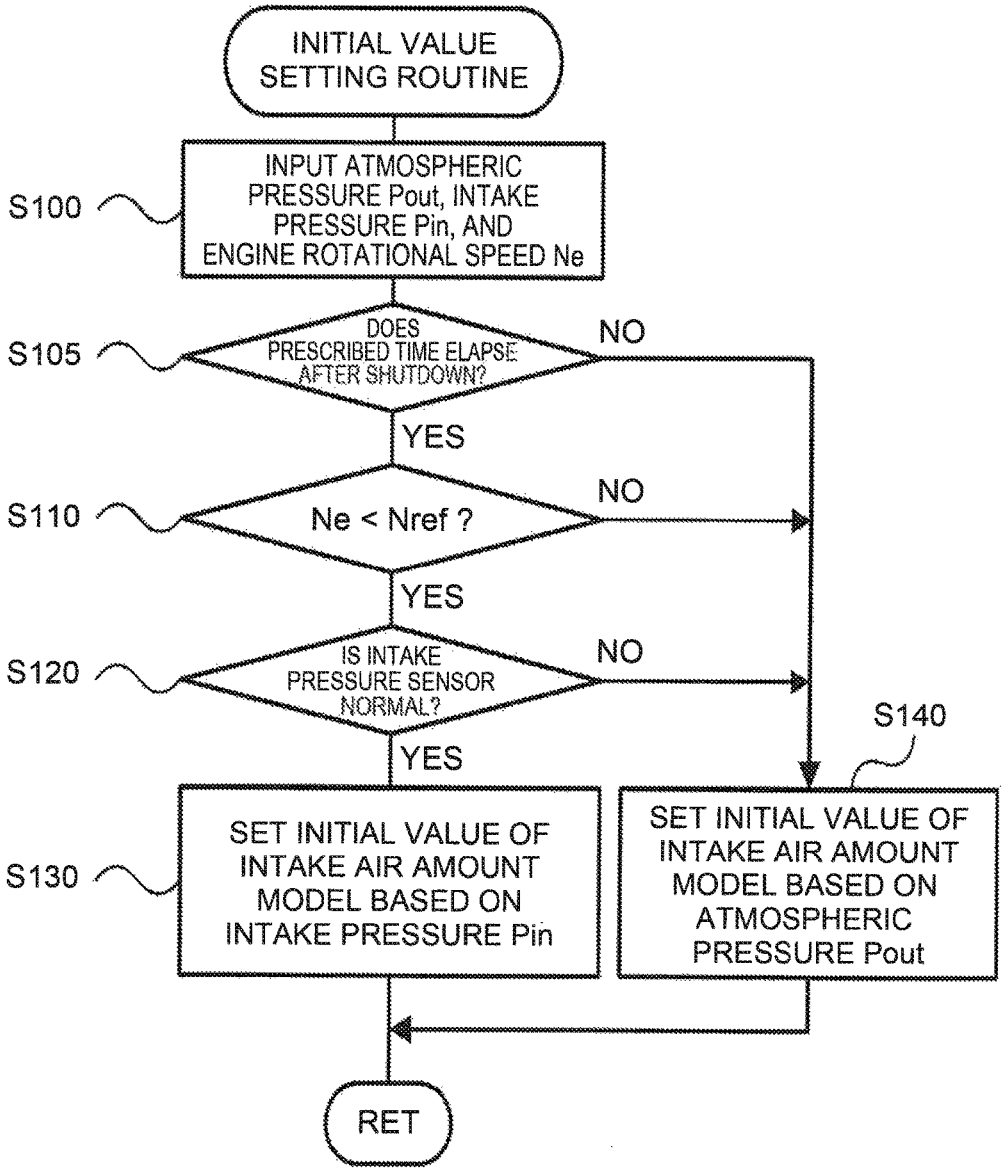
FIG. 4 is a flowchart illustrating one example of the initial value setting routine in a modification.

In the engine system 10 of the embodiment, when it is determined that the rotational speed Ne of the engine 12 is less than the threshold value Nref when the fuel injection control is started at the start-up of the engine 12, the initial value of the intake air amount model based on the intake pressure Pin from the intake pressure sensor 58 is set. However, the initial value of the intake air amount model based on the intake pressure Pin from the intake pressure sensor 58 may be set only when the engine 12 is started up before the pressure of the intake pipe 25 returns to the atmospheric pressure after the engine 12 is stopped. In this case, an initial value setting routine of FIG. 4 may be executed in place of the initial value setting routine of FIG. 2. The initial value setting routine of FIG. 4 includes step S105 added between step S100 and step S110 of the initial value setting routine of FIG. 2. In the initial value setting routine of FIG. 4, the atmospheric pressure Pout from the atmospheric pressure sensor 72, the intake pressure Pin from the intake pressure sensor 58, and the rotational speed Ne of the engine 12 are input (step S100), and it is determined whether or not prescribed time elapses after the engine 12 is stopped (step S105). Here, the prescribed time is the time necessary for the pressure of the intake pipe 25 to return to the atmospheric pressure after the stop of the engine 12. The prescribed time may be determined by an experiment and the like. When it is determined that the prescribed time does not elapse after the engine 12 is stopped, the initial value of the intake air amount model based on the atmospheric pressure Pout from the atmospheric pressure sensor 72 and the atmospheric pressure learning is set (step S140), and the present routine is ended. When it is determined that the prescribed time elapses after the engine 12 is stopped, it is confirmed that the rotational speed Ne of the engine 12 is less than the threshold value Nref and that the intake pressure sensor 58 is normal (steps S110, S120). Then, the initial value of the intake air amount model based on the intake pressure Pin from the intake pressure sensor 58 is set (step S130), and the present routine is ended. In the case of the modification, the effect same as that of the embodiment can also be demonstrated.

Correspondence relation between the main elements of the embodiments and the main elements of the present disclosure described in Summary will be described. In the embodiments, the engine 12 is one example of "engine", the atmospheric pressure sensor 72 is one example of "atmospheric pressure sensor", the electronic control unit 70 is one example of "electronic control unit", and the intake pressure sensor 58 is one example of "intake pressure sensor."

Since the embodiments are examples for specific description of the modes for carrying out the present disclosure described in Summary, the correspondence relation between the main elements of the embodiment and the main elements of the present disclosure described in Summary is not intended to limit the elements of the disclosure described in Summary. More specifically, the disclosure disclosed in Summary should be interpreted based on the description therein, and the embodiments are merely specific examples of the disclosure disclosed in Summary.

Although the modes for carrying out the present disclosure have been described using the embodiments, the present disclosure is not limited in any manner to the embodiments disclosed. It should naturally be understood that the present disclosure can be carried out in various modes without departing from the scope of the present disclosure.

The present disclosure is applicable in the fields such as manufacturing of the engine system.

What is claimed is:

1. An engine system comprising:

an engine;

an atmospheric pressure sensor;

an intake pressure sensor configured to detect intake pressure of the engine; and an electronic control unit configured to execute atmospheric pressure learning for learning a relation between atmospheric pressure and an intake air amount of the engine based on the atmospheric pressure detected by the atmospheric pressure sensor, the electronic control unit being configured to execute fuel injection control of the engine using an initial value of an intake air amount model obtained based on the atmospheric pressure learning, and the electronic control unit being configured to execute the fuel injection control of the engine using an initial value of the intake air amount model obtained based on the intake pressure detected by the intake pressure sensor, when rotational speed of the engine is less than a specified rotational speed at start of the fuel injection control of the engine.

2. The engine system according to claim 1, wherein the electronic control unit is configured to execute the fuel injection control using the initial value of the intake air amount model obtained based on the atmospheric pressure learning irrespective of the rotational speed of the engine, when prescribed time or more elapses after shutdown of the engine.

3. The engine system according to claim 1, wherein the electronic control unit is configured to execute the fuel injection control using the initial value of the intake air amount model obtained based on the atmospheric pressure learning irrespective of the rotational speed of the engine, when abnormality occurs in the intake pressure sensor.

4. A control method for an engine system, the engine system including an engine, an atmospheric pressure sensor, an intake pressure sensor, and an electronic control unit, the intake pressure sensor being configured to detect intake pressure of the engine, the control method comprising:

executing, by the electronic control unit, atmospheric pressure learning for learning a relation between atmospheric pressure and an intake air amount of the engine based on the atmospheric pressure detected by the atmospheric pressure sensor;

executing, by the electronic control unit, fuel injection control of the engine using an initial value of an intake air amount model obtained based on the atmospheric pressure learning; and executing, by the electronic control unit, the fuel injection control of the engine using an initial value of the intake air amount model obtained based on the intake pressure detected by the intake pressure sensor, when rotational speed of the engine is less than a specified rotational speed at start of the fuel injection control of the engine.

* * * * *